US010144487B1

(12) United States Patent
Craig

(10) Patent No.: US 10,144,487 B1
(45) Date of Patent: Dec. 4, 2018

(54) COLLAPSIBLE HIGH-PERFORMANCE MULTI-HULLED WATERCRAFT FOR USE IN A VARIETY OF SETTINGS

(71) Applicant: Robert Craig, Orlando, FL (US)

(72) Inventor: Robert Craig, Orlando, FL (US)

( * ) Notice: Subject to any disclaimer, the term of this patent is extended or adjusted under 35 U.S.C. 154(b) by 0 days.

(21) Appl. No.: 15/677,241

(22) Filed: Aug. 15, 2017

(51) Int. Cl.

| | |
|---|---|
| ***B63B 1/20*** | (2006.01) |
| ***B63B 1/12*** | (2006.01) |
| ***B63B 29/04*** | (2006.01) |
| ***B63B 17/02*** | (2006.01) |
| ***B63B 5/24*** | (2006.01) |
| ***B63H 20/06*** | (2006.01) |

(52) U.S. Cl.
CPC ..... *B63B 1/20* (2013.01); *B63B 1/12* (2013.01); *B63B 5/24* (2013.01); *B63B 17/02* (2013.01); *B63B 29/04* (2013.01); *B63H 20/06* (2013.01); *B63B 2001/209* (2013.01); *B63B 2005/242* (2013.01); *B63B 2029/043* (2013.01); *B63B 2709/00* (2013.01)

(58) Field of Classification Search
CPC .... B63B 1/00; B63B 1/16; B63B 1/20; B63B 1/22; B63B 1/12; B63B 1/14
USPC ..... 114/61.1, 283, 292, 354
See application file for complete search history.

(56) References Cited

U.S. PATENT DOCUMENTS

| | | | | | |
|---|---|---|---|---|---|
| 3,111,924 | A * | 11/1963 | Wightman | B63B 1/20 | 114/283 |
| 3,230,918 | A * | 1/1966 | Compton | B63B 1/14 | 114/283 |
| 3,326,166 | A * | 6/1967 | Yost | B63B 1/14 | 114/283 |
| 5,529,008 | A * | 6/1996 | Craig | B63B 1/121 | 114/61.1 |
| 6,085,677 | A * | 7/2000 | Bell | B63B 1/12 | 114/61.1 |
| 6,085,678 | A * | 7/2000 | Wurzburg | B63B 35/795 | 114/61.1 |

* cited by examiner

*Primary Examiner* — Lars A Olson
(74) *Attorney, Agent, or Firm* — The Rapacke Law Group, P.A.

(57) ABSTRACT

Embodiments described herein provide a collapsible high-performance multi-hulled watercraft which may be easily assembled/disassembled and comprised of a plurality of symmetrically shaped planar hulls which are laterally spaced and provide a shallow water draft; a deck platform releasably attached and overlying the plurality of symmetrically shaped planar hulls having at least one seat, marine radar, translucent protective shield and skid plate; and at least one propulsion unit which may releasably attached to the platform and which extends below the water line to enable high performance stability and maneuverability to the vessel.

20 Claims, 7 Drawing Sheets

COLLAPSIBLE HIGH-PERFORMANCE MULTI-HULLED WATERCRAFT FOR USE IN A VARIETY OF SETTINGS

FIELD

The present embodiment relates to a collapsible high-performance multi-hulled watercraft, and in particular to a collapsible high-performance catamaran watercraft containing a plurality of planar multi-hulls which provide improve stability and maneuverability, and allow operation in a variety of sea state conditions.

BACKGROUND

Traditional sailboats and monohull vessels have been used for centuries to support personnel transportation, fishing, and military operations. These basic designs included large sails attached to a mast which propelled the vessel through the water. Stability was often enhanced by re-positioning goods and people along the main deck, or adding water and artificial weights to the hull to create a keel. As these displacement hull designs evolved, their stability was often improved by sacrificing speed and maneuverability through the waves.

These first rudimentary designs gave way to vessels with multiple hulls that are able to plane over the water with less draft and at faster speeds. As racing and yachting increased the innovation in naval architecture, watercraft became fitted with planar hulls which allowed for even greater speed and maneuverability.

Today these multi-hulled catamaran designs are able to reach incredible speeds and outperform the monohull vessels with the same dimensions but provide increased danger in high-speed turns due to the lower center of gravity and shallower drafts. Hull technology now provides for symmetrically and non-symmetrically shaped hulls which may be oriented in a variety of configurations to help counter these stability challenges, but often lead to reduced speed and maneuverability.

Often these watercraft may be seen leaning outwardly during a high sped turn and if not controlled, may lead to capsizing. This "heeling phenomenon" is created by both a hulls design and the centrifugal forces against it during a turn. During Regatta's these high speed sailboats often heel to a point where at least one hull is out of the water requiring the crew to quickly position along the main deck until the vessel has righted. Though technology has created faster and more maneuverable vessels, the physics and hydrodynamics of turns continue to lead to heeling and capsizing with these high-speed watercraft.

Though there are several portable, high-performance catamaran watercrafts which provide for enhanced stability and turning performance using planar hull technology such as U.S. Pat. No. 5,090,648 to Wood; U.S. Pat. No. 4,877,045 to Lin; and U.S. Pat. No. 4,777,642 to Cruz; there is not single reference which enables high-speed turns while prevent any "heeling effects" and provide for immediate planing along the surface of the water when propulsion is provided.

SUMMARY OF THE INVENTION

Embodiments described herein provide for a collapsible high-performance multi-hulled watercraft with enhanced stability and dynamic maneuverability and which may be used in a variety of settings and sea state conditions. The watercraft is comprised of a plurality of planar hulls, deck platform, and a propulsion unit which may be easily aligned and assembled for transport and storage. When fully assembled, the watercraft evenly distributes the 850-pound displacement onto the planar hulls creating a six-inch draft. This light weight watercraft with a hull length to width ratio of 5:1 and is not only able to perform turns with a tighter radius, but "lean" into a turn in the same manner as a traditional V-shaped monohull vessel.

The watercraft's unique configuration provides hydrodynamic stability in shallow water and heavy seas environments which is ideal for recreational, commercial, and military settings. The planar deck platform includes a plurality of releasably attached accessories including at least: one seat, a marine radar, cleats, a translucent protective shield, and retractable awning. The fiberglass deck platform and skid platforms can absorb and disperse stresses and vibration from the hull along the deck of the craft before reaching the operator to create a smoother and stable platform. This stability control further prevents any sudden or erratic movements from leading to capsizing or heeling.

In addition, the watercraft includes a remote propulsion and steering console located at the watercraft's mid-section while allowing the operator complete steering and power control from the operator seat.

Further embodiments provide the collapsible high-performance multi-hulled watercraft equipped with a mounted centerline outboard engine, and releasably attached skegs providing enhanced stability in shallow water environments. For example, it is contemplated the watercraft may be fitted with a swivel mounted centerline outboard engine, which when combined with the minimal planar draft area, provides a watercraft that can be utilized in recreational, military, and commercial settings.

Other aspects, advantages, and novel features of the embodiments will become apparent from the following detailed description in conjunction with the drawings.

BRIEF DESCRIPTION OF THE DRAWINGS

A more complete understanding of the embodiments, and the attendant advantages and features thereof, will be more readily understood by reference to the following detailed description when considered in conjunction with the accompanying drawings wherein.

DETAILED DESCRIPTION

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

The embodiments provided describe a collapsible high-performance multi-hulled watercraft with overall length between 11-12 feet and width of 5-6 feet and provides improved handling and performance from traditional motorized catamarans. The light-weight watercraft is further designed to be trailered and assembled "on site" by simply attaching the planar hulls within a coupling located on the bottom of the deck platform and attaching a propulsion unit onto the deck platform.

The watercraft is comprised of a plurality of flat-bottom planar hulls which provide less hydrodynamic draft and create a minimal draft. To further enhance buoyancy, each of the planar hulls is filled with core cell foam. The bottom surface of the deck platform includes a shock-absorbing skid plate, which provides both a barrier to the propulsion unit, and acts to help disperse the stresses placed onto the planar hulls and deck platform. When performing high-speed turns, the planar hull design, automatic stability control, and propulsion unit allows the watercraft to perform "tighter" turns by banking inside rather than be subject to a pronounced heeling effect.

The embodiments provide for a watercraft dimensioned with an overall length to width of 5/1 with a reduced frictional forces acting on the bottom side of eachhull. This planar design in association with the unique dimensions allow the craft to immediately plane from the idle position without any bowing commonly found in traditional motorized watercraft.

Figure 1:
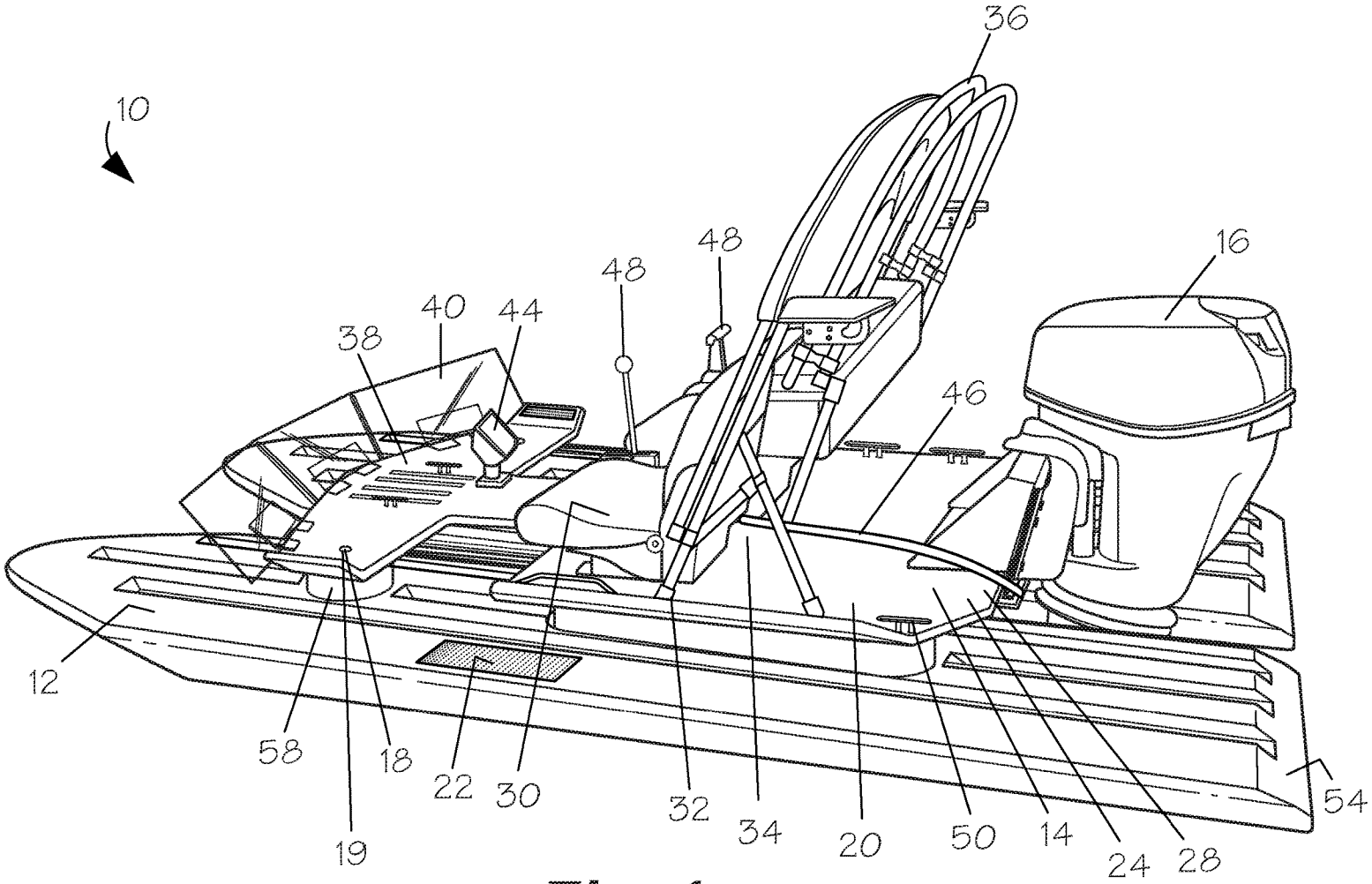
FIG. 1 is a perspective view of a collapsible high-performance multi-hulled watercraft.

Referring now to the drawings wherein like reference numerals designate identical or corresponding parts throughout the views. There is shown in FIG. 1 a collapsible high-performance multi-hulled watercraft 10 which may be used in a variety of settings and sea state conditions. The apparatus 10 is comprised of a plurality of symmetrically shaped planar hulls 12, deck platform 14, and at least one propulsion unit 16 and may be readily assembled/disassembled for convenient travel and storage using a plurality of couplings and fasteners 18.

The watercraft 10 is designed to allow an operator to assemble the craft by first placing the plurality of symmetrically shaped planar hulls 12 on a substantially level ground surface and then securing the deck platform 14 using the coupling and fasteners 18 which may be vertically inserted within a plurality of securing apertures 19 along the top surface of the planar deck platform 20. Once the planar deck platform 14 is securely fastened with the plurality of symmetrically shaped planar hulls 12, the operator may board the vessel by stepping up and onto a slip-resistant adhesive exterior surface 22 of the plurality of symmetrically shaped planar hulls 12 which provides a slip-resistant surface along the horizontal top surface of the plurality of symmetrically shaped planar hulls 24 after being exposed to waves and sea spray. The final step before completing installation requires that the operator to mount the at least one propulsion unit 16 to an engine mount 26 at the aft end of the planar deck surface 28 or onto the top surface of the planar deck platform 20.

Once the operator has completed the basic 15-minute installation, they may then set up the accessories on the planar deck platform 14 but attaching the at least one seat 30 with its corresponding seat bracket 32 located in the mid section of the planar deck surface 34. To protect the operator from adverse weather and sun exposure, a retractable awning 36 may be mounted along each side of the at least one seat 30 within an awning bracket 37. The awning 36 is designed to be retracted from its stationary folded position just above the at least one seat 30 outward toward the forward perimeter of the planar deck platform 38 to provide either partial or complete protection from the elements.

The watercraft 10 and retractable awning 36 may be further upgraded to include fishing rod brackets (shown in FIG. 9) or with speakers, docking stations, and light emitting diode (LED) navigation lights, and two-way speakers. In addition to the retractable awning 36, the operator is further sheltered from heavy sea state conditions by a sectional translucent shield 40 located along the forward perimeter of the deck platform 38. The watercraft 10 is further equipped with a marine radar 43 which may be releasably inserted within it's corresponding bracket 44 just forward of the at least one seat 30 to provides a complete navigation picture to the operator including traffic density, course, and heading information of adjacent ships. In order to avoid any collisions, a remote propulsion/steering console attached using a control cable 49 allows the operator to maintain unobstructed control of the watercraft 10 from the at least one seat 30.

Before getting underway, the operator may secure the watercraft 10 to a dock for loading/unloading by securing a mooring line from the dock to the at least one of the plurality of securing cleats 50 located along the top surface of the planar deck platform 20. The operator may then load the watercraft 10 with up to 600 pounds of personnel or gear by initially stepping onto the slip-resistant adhesive exterior surface 22 located on a portion of the top surface of the plurality of symmetrically shaped planar hulls 24, and then onto the deck platform 14.

Figure 2:
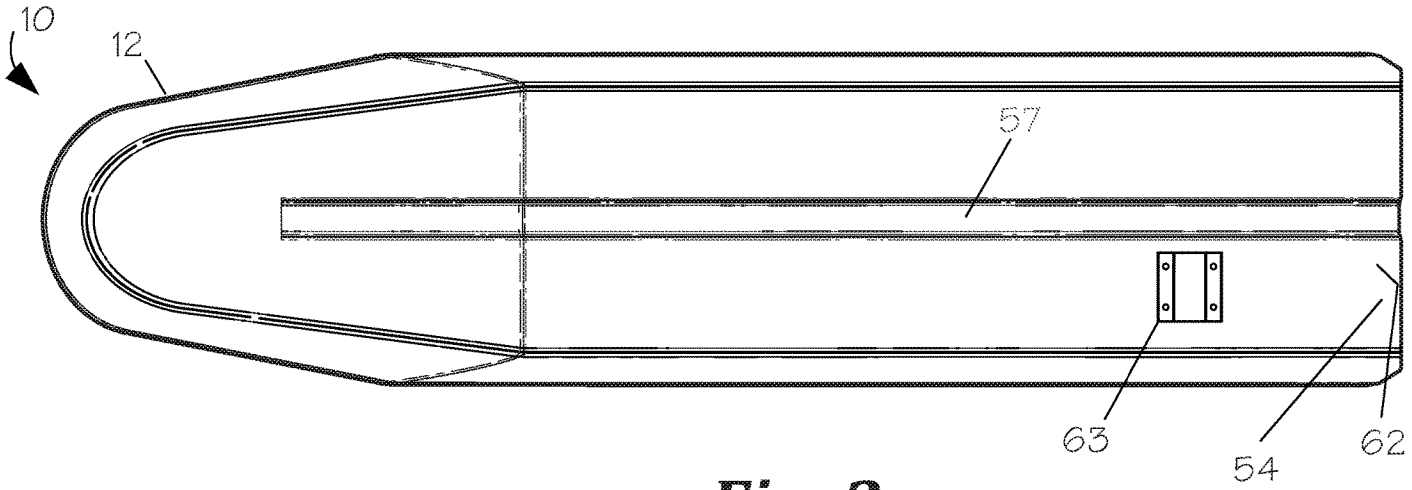
FIG. 2 is a planar view of a symmetrically shaped planar hull.

Referring now to FIG. 2 is a planar view of one of the plurality of symmetrically shaped planar hulls 12 which are laterally spaced. The planar design allows for hydrodynamic stability without the need of an elongated keel, ballast system, or trim tabs while reducing drag; a feature that allows the watercraft 10 to begin its lateral and planar mode of operation along the surface of the water once power is applied.

The plurality of symmetrically shaped planar hulls 12 while substantially rectangular in shape, further include a bow 52 located at the foremost point of the watercraft 10 and stern 54 section in the rear. The bow 52 is round and includes an upwardly angled planar region from the waterline to the top surface of each of the plurality of symmetrically shaped planar hulls 24. This sloped frontal region further reduces the frictional forces acting on the watercraft 10 and increases fuel efficiency. The stern 54 has a larger width than the bow 52 and includes inwardly angled sidewalls 55 which act to reduce the watercraft's wake.

Further illustrated in FIG. 2 is a view of the outward protruding male fitting 56 located along a centerline axis 57 and designed to fit within the corresponding female fitting 58 (shown in FIG. 1) of the planar deck platform 14 when assembling the watercraft 10 and provide a vertical spacing between the horizontal top surface of the plurality of symmetrically shaped planar hulls 24 and the bottom surface of the planar deck platform 60 which allows the watercraft 10 to operate in heavier sea states.

Figure 3:
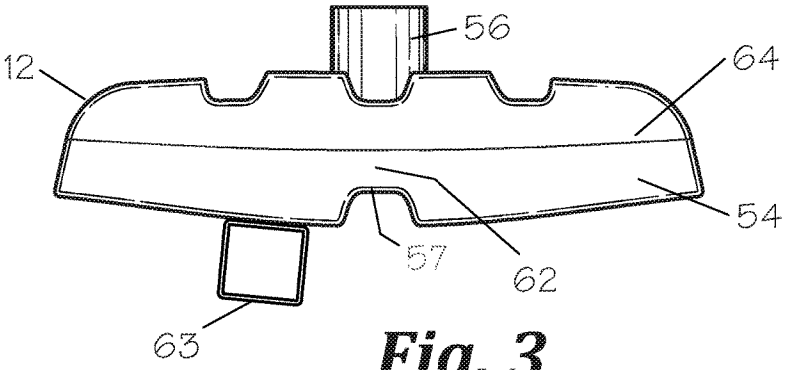
FIG. 3 is a cross-sectional view of the symmetrically shaped planar hull.

Referring now to FIG. 3 is a cross-sectional view of the plurality of a symmetrically shaped planar hulls 12 having an inverted "V-shaped" configuration and forming a concave region at the centerline axis 57 which further houses a keel 62. During high-speed turns, the centerline axis 57 and keel 62 counter the force produced by the thrusting vector by banking the inside hulls into the water to perform sharper turns In addition to an keel 62, each of the plurality of symmetrically shaped planar hulls 12 includes a high-pressure core cell foam filler which prevents moisture accumulation to each of the hulls and provide a greater buoyant force to the watercraft 10. The 40,000-50,000 psi polyethylene foam is sprayed within the interior region 64 and until filled, providing enhanced structural integrity to each of the plurality of symmetrically shaped planar hulls 12 preventing a skipping effect while planing a rough surface.

Figure 4:
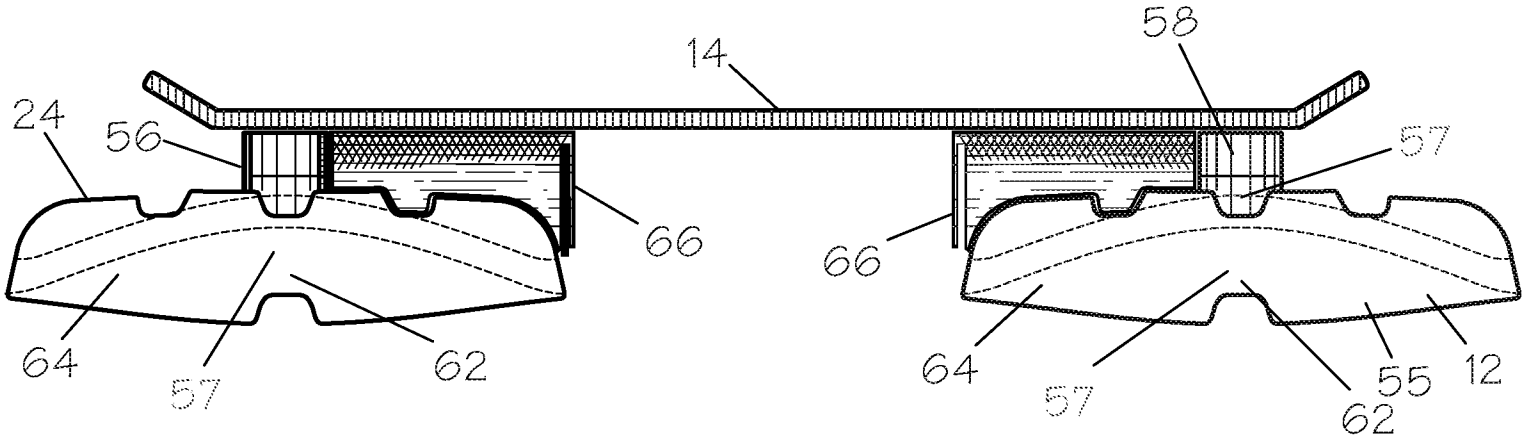
FIG. 4 is a cross-sectional view of the symmetrically shaped planar hull releasably attached to the planar deck platform at a male-female coupling.

Referring now to FIG. 4 is a cross-sectional view of the plurality of symmetrically shaped hulls 12 each of which is filled with a high-pressure (40-50k psi) core cell foam filler. In the current illustration, the watercraft 10 is assembled with the deck platform 14 overlying the plurality of symmetrically shaped planar hulls. The plurality of flexible splash guards 64 provides a barrier to the vertical gap created between the deck platform 14 and plurality of symmetrically shaped planar hulls 12. The splash guards 66 which are affixed to the bottom surface of the deck platform 60 ensure the horizontal top surface of the plurality of symmetrically shaped planar hulls 24 remains dry and safe for passenger onload/offload.

Figure 5:
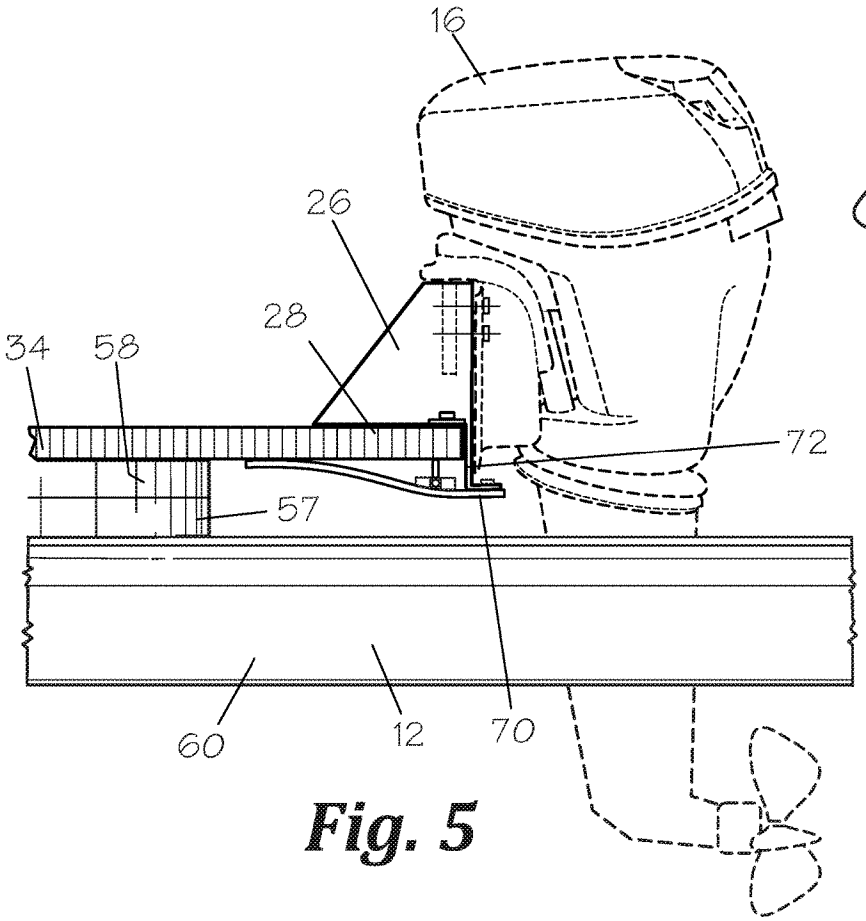
FIG. 5 is a view of the propulsion unit mounted to the engine mount and skid plate at the aft end of the watercraft.

Referring now to FIG. 5 is a view of the propulsion unit 16 releasably mounted onto the engine mount 26 at the aft end of the planar deck surface 34. The watercraft's width and large deck area at the aft end of the deck platform 28 allow for gear storage or fuel tanks to be securely fastened. However, it is contemplated the watercraft 10 will be equipped with at least one outboard direct injection motor which provides highly responsive throttle control (shown in FIG. 9) at the remote propulsion/steering control console 48 to the operator.

This at least one propulsion unit 16 when releasably mounted is located adjacent to the skid plate 70 at both the bottom and top of the engine mount 72, 74. In order to minimize vibration and torque to the deck platform 14, an elastic shock absorbing skid plate mounting bracket 75 is inserted between the skid plate 70 and bottom surface of the deck platform 60 todissipate the stress placed on the deck from transferring to the operator in the at least one 30 In addition to the primary function as a barrier to the at least one propulsion unit 16, the skid plate 70 further acts similar to an airfoil by diverting air from between the plurality of symmetrically shaped planar hulls 12 upward against the bottom surface of the deck platform 60.

Figure 6:
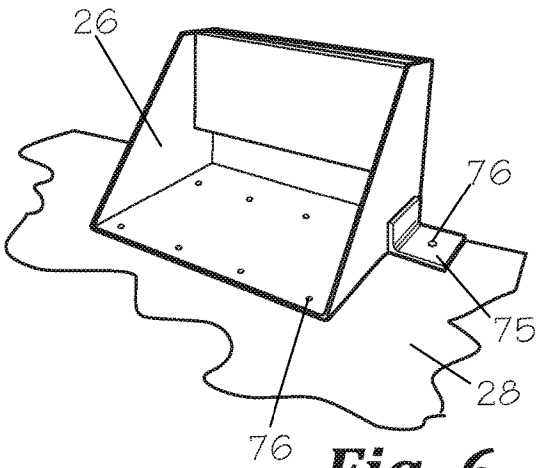
FIG. 6 is a detailed view of the engine mount.

Referring now to FIG. 6 is a detailed view of the engine mount 26 including the engine mount bracket 75 and corresponding fasteners 76. As above-discussed, during assembly of the watercraft 10, the operator may secure the at least one propulsion unit 16 to the craft by releasably mounting the bracket using clamps or fasteners 18 at the bracket mount apertures.

Figure 7:
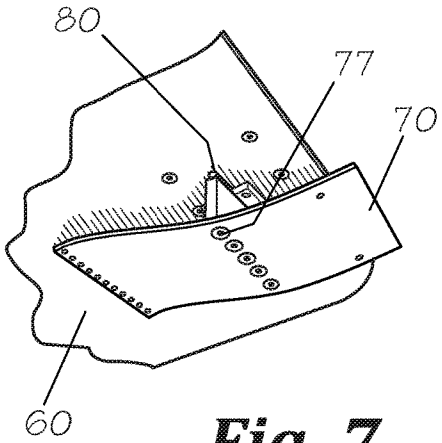
FIG. 7 is a detailed view of the skid plate attached to the bottom side of the deck platform.

Referring now to FIG. 7 is a detailed view of the skid plate 70 releasably mounted along the bottom surface of the planar deck platform 60 using a plurality of skid plate fasteners 77. The skid plates"70 configuration on the watercraft 10 adds dynamic stability through the water and adds lift to the plurality of symmetrically shaped planar hulls 12 by acting as foil and directing air upward onto the bottom surface of the deck platform 60 which enables the watercraft 10 to immediately plane along the water surface during acceleration and reach top speed in under three seconds with little or no vibration transferred to the operator. Contrary to traditional catamrans, the present embodiments provide a shock absorber 80 between the skid plate 70 and bottom surface of the deck platform 60.

Figure 8:
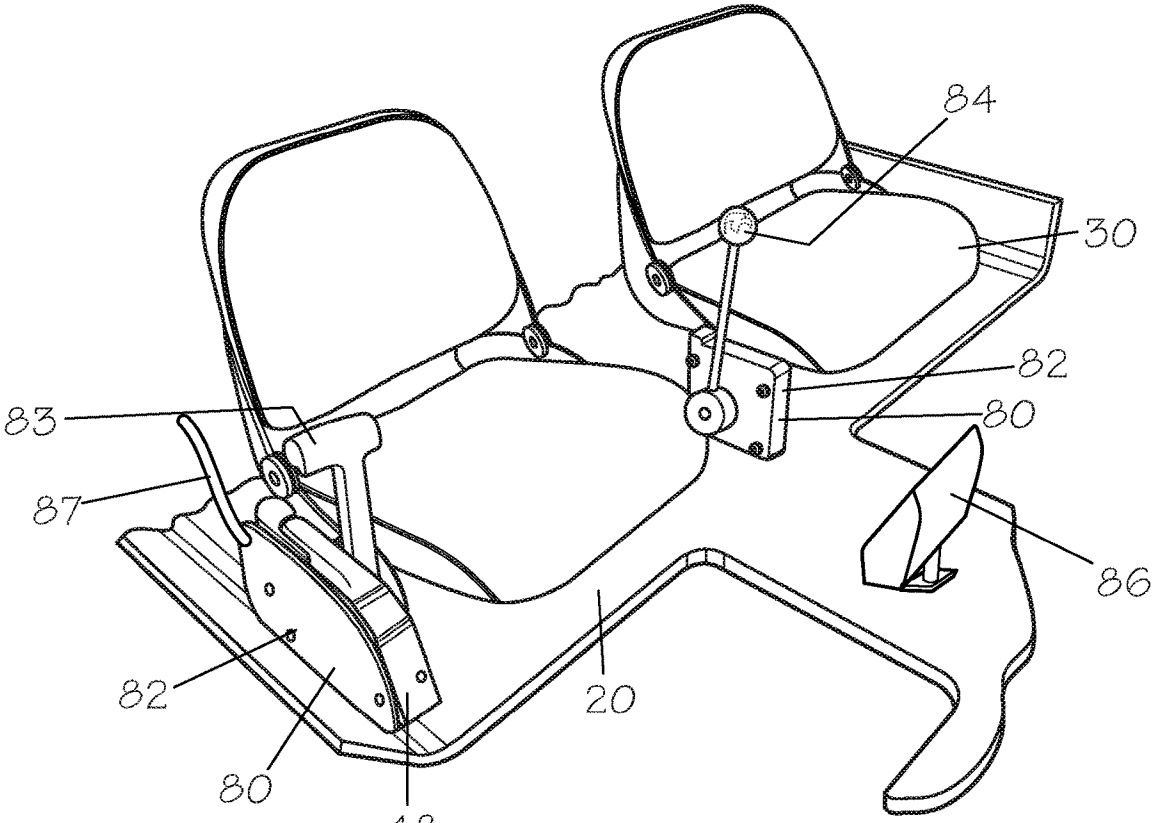
FIG. 8 is a view of the seat and remote propulsion/steering control console.

Referring now to FIG. 8 is a view of the at least one seat 30 and remote propulsion/steering control console 48 attached to the propulsion steering control cable 49 allowing navigation watercraft 10 from their forward facing seat. The remote propulsion/steering control console 48 is releasably mounted to the top surface of the deck platform 20 with its corresponding bracket 82. The present illustration allows the operator to control the throttle 83 with his right hand and steering control lever 84 with his left hand. However, the watercraft 10 may allow the remote propulsion/steering control console 48 to be arranged in a variety of positions.

The watercraft 10 further includes an integrated stability control system 86 to prevent sudden or erratic course changes from capsizing the watercraft 10. For example, if the operator were to lose control of the steering control lever 84, the watercraft 10 would not allow cause a sudden and erratic course change. Rather the stability control system 86 and width of the watercraft 10 will respond to the command with a measured and calculated response through the steering cable 87.

Figure 9:
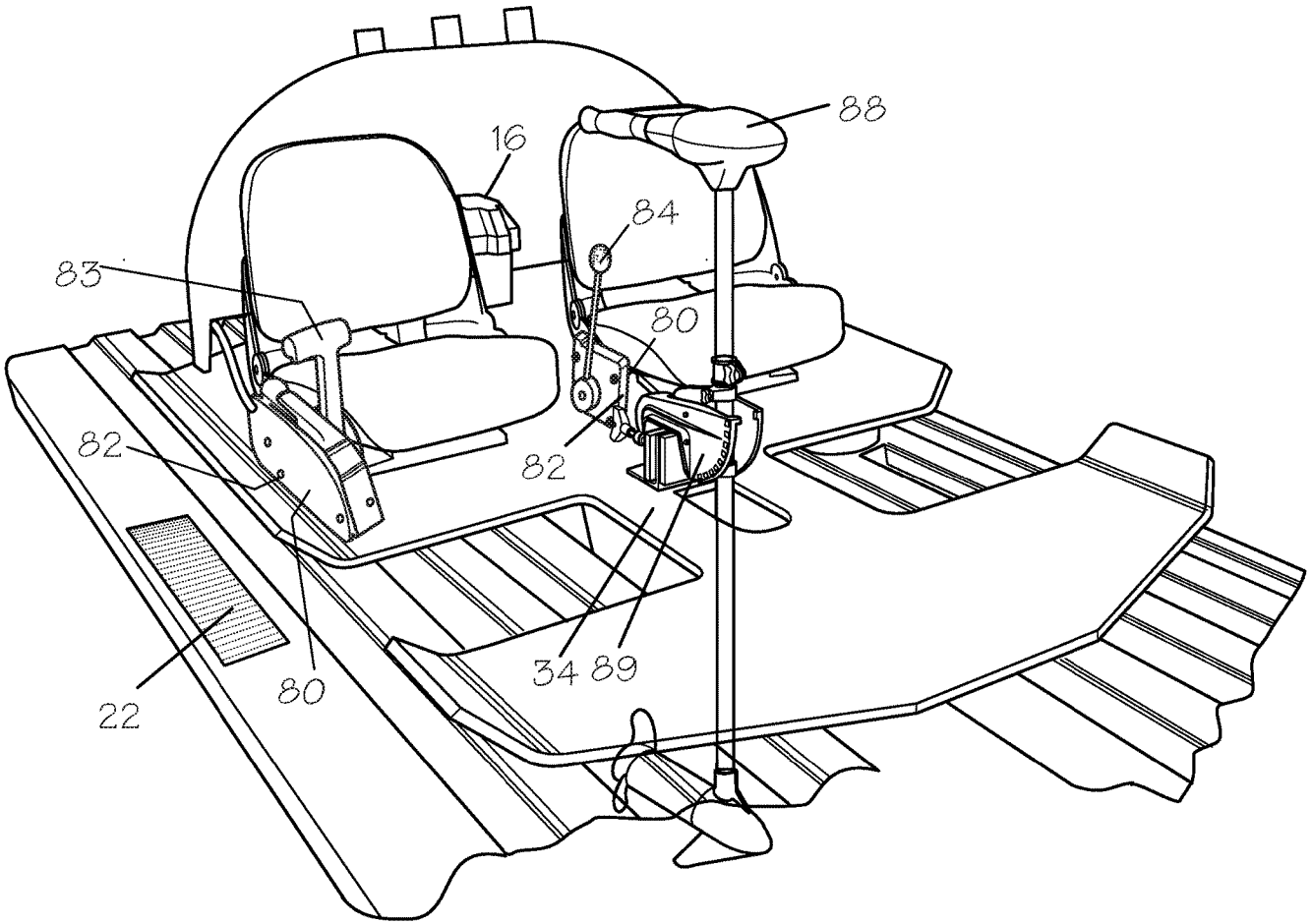
FIG. 9 is a view with the propulsion unit releasably affixed to a propulsion mount.

Referring now to FIG. 9 is a view of the watercraft 10 fitted with the at least one prolusion unit 16 located on a centerline swivel mount 89. Further illustrated in FIG. 9 is a view of a concave region located along the perimeter of the deck platform 38.

Figure 10:
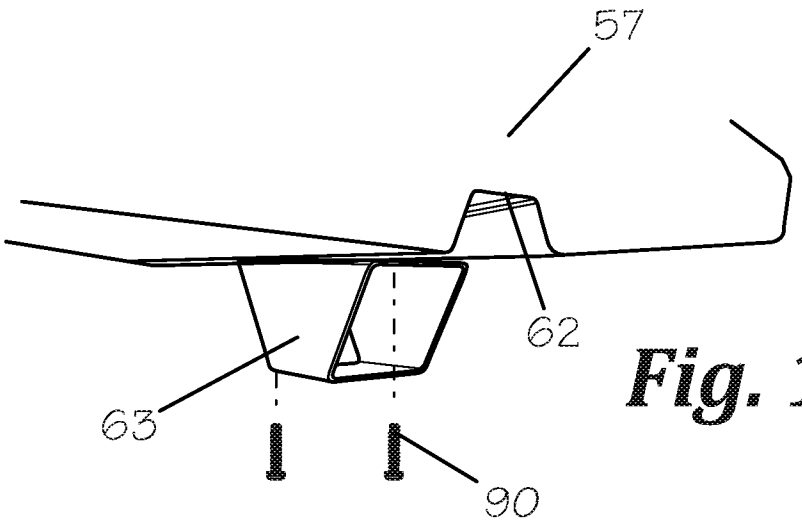
FIG. 10 is a view of a skeg attached to the bottom of at least one planar hull.

Referring now to FIG. 10 is a view of the at least one of the plurality of symmetrically shaped planar hulls 12 including the skeg 63 and corresponding fasteners 91.

It will be appreciated by persons skilled in the art that the present embodiment is not limited to what has been particularly shown and described hereinabove. In addition, unless mention was made above to the contrary, it should be noted that all of the accompanying drawings are not to scale. A variety of modifications and variations are possible in light of the above teachings without departing from the following claims.

What is claimed is:

1. A planar hulled catamaran watercraft which provides a planing mode of operation along a water surface, the watercraft comprising:

a plurality of symmetrical shaped and laterally spaced planar hulls releasably attached to a deck platform at a male/female couple and configured to prevent a heeling effect during a turn;

a deck platform substantially parallel to the water surface and overlaying the plurality of symmetrically shaped planar hulls to provide a surface to at least one propulsion unit and a remote steering/propulsion control system; and at least one propulsion unit releasably affixed to an engine mount on the deck platform to provide an acceleration while performing in the planing mode of operation.

2. The watercraft of claim 1, wherein the plurality of symmetrical shaped and laterally spaced planar hulls have a length to width ratio of 5:1.

3. The watercraft of claim 2, wherein the plurality of symmetrical shaped and laterally spaced planar hulls further includes a textured adhesive portion on a top surface to provide a slip resistant footing.

4. The watercraft of claim 3, wherein the plurality of symmetrically shaped and laterally spaced planar hulls further includes a polyethylene closed cell foam within an interior void to provide a six-inch draft to the watercraft.

5. The watercraft of claim 4, wherein the deck platform further includes a plurality of elastic and evenly spaced splash guards.

6. The watercraft of claim 5, wherein the deck platform further includes at least one forward facing seat.

7. The watercraft of claim 5, wherein the deck platform further includes a releasably attached translucent protective shield.

8. The watercraft of claim 1, wherein the deck platform further includes a shock mounted skid plate at a bottom surface to provide a barrier to the at least one propulsion unit.

9. The watercraft of claim 1, wherein the deck platform further includes a releasably attached retractable awning.

10. A collapsible multi-hulled watercraft which provides improved stability control and maneuverability, the watercraft comprising:

a plurality of symmetrically shaped and laterally spaced planar hulls releasably attached a male/female coupling to a deck platform to provide a planing mode of operation along a water surface;

a substantially horizontal deck platform releasably attached to the plurality of symmetrically shaped and laterally spaced planar hulls at a male/female coupling and further including:

at least one releasably attached seat;

a releasably attached translucent protective shield about a portion of a forward perimeter;

a plurality of flexible splash guards;

a releasably attached and retractable awning;

at least one securing cleat; and a remote propulsion/steering control console electrically connected to an at least one propulsion unit;

at least one propulsion unit releasably attached to an engine mount along the substantially horizontal deck platform.

11. The watercraft of claim 10, further including an integrated stability control which provides a controlled response to a sudden steering command.

12. The watercraft of claim 10, wherein the plurality of symmetrically shaped and laterally spaced planar hulls further includes a core cell foam filler to increase a buoyant force acting on the watercraft.

13. The watercraft of claim 12, further including a shock mounted skid plate to redirect an air flow from between the plurality of symmetrically shaped and laterally spaced planar hulls to a bottom surface of the substantially horizontal deck platform while in the planing mode of operation along the water surface.

14. The watercraft of claim 10, wherein the substantially horizontal deck platform is comprised of a shock-absorbing fiberglass material.

15. The watercraft of claim 14, wherein the substantially horizontal deck platform includes a concave perimeter portion.

16. The watercraft of claim 10, wherein at least one of the plurality symmetrically shaped and laterally spaced planar hulls includes a skeg.

17. A compact multi-hulled watercraft which provides a planing mode of operation along a surface of water; the watercraft comprising:

a plurality of symmetrically shaped and laterally spaced planar hulls including a core cell foam filler releasably attached at a male/female coupling to a fiberglass platform deck to provide a six-inch draft while in the planing mode of operation along the surface of water;

a shock-absorbing fiberglass platform deck releasably attached to the plurality of symmetrical shaped and laterally spaced planar hulls and further including:

at least one releasably attached operator seat;

a removable translucent protective shield to provide a barrier to the at least one attached operator seat;

a plurality of flexible splash guards;

a releasably attached and retractable awning;

at least one securing cleat; and a remote propulsion/steering control console in electrical communication with an at least one direct injection outboard propulsion unit;

at least one direct injection outboard propulsion unit releasably mounted to an engine mount on the shock-absorbing fiberglass platform deck.

18. The watercraft of claim 17, further including an automatic stability control mechanism to provide a timed response to a sudden course change.

19. The watercraft of claim 17, further including a shock mounted skid plate to direct an airflow from between the plurality of symmetrically shaped and laterally spaced planar hulls to a bottom surface of the shock-absorbing fiberglass platform deck and enhance a buoyant force acting on the watercraft to the bottom surface of the removable fiberglass platform and increase a buoyant force onto the watercraft.

20. The watercraft of claim 19, further preventing a heeling effect while traveling in the continuous planing mode of operation.

* * * * *